United States Patent [19]

Stahlecker et al.

[11] 4,276,741

[45] * Jul. 7, 1981

[54] METHOD AND APPARATUS FOR START-SPINNING A THREAD ON AN OPEN-END SPINNING UNIT

[75] Inventors: Fritz Stahlecker, Josef-Neidhart-Str. 18, D 7341 Bad Ueberkingen; Dietrich Zilian, Sussen, both of Fed. Rep. of Germany

[73] Assignees: Fritz Stahlecker; Hans Stahlecker, both of Sussen, Fed. Rep. of Germany

[ * ] Notice: The portion of the term of this patent subsequent to Oct. 26, 1993, has been disclaimed.

[21] Appl. No.: 933,985

[22] Filed: Aug. 16, 1978

Related U.S. Application Data

[63] Continuation of Ser. No. 493,158, Jul. 30, 1974, abandoned.

[30] Foreign Application Priority Data

Aug. 16, 1973 [DE] Fed. Rep. of Germany ..... 2341528

[51] Int. Cl.[3] ..... D01H 15/02

[52] U.S. Cl. ..... 57/263; 57/93

[58] Field of Search ..... 57/58.89–58.95, 57/93, 263

[56] References Cited

U.S. PATENT DOCUMENTS

| | | | |
|---|---|---|---|
| Re. 30,201 | 2/1980 | Stahlecker et al. | 57/263 |
| 3,354,626 | 11/1967 | Cizek et al. | 57/58.89 X |
| 3,541,774 | 11/1970 | Sterba et al. | 57/58.95 X |
| 3,695,017 | 10/1972 | Hori et al. | 57/263 |
| 3,698,174 | 10/1972 | Boucek et al. | 57/58.95 |
| 3,704,579 | 12/1972 | Tooka et al. | 57/263 |
| 3,780,513 | 12/1973 | Watanabe et al. | 57/93 |
| 3,791,128 | 2/1974 | Landwehrkamp et al. | 57/93 |
| 3,810,352 | 5/1974 | Miyazaki et al. | 57/263 |

*Primary Examiner*—John Petrakes

*Attorney, Agent, or Firm*—Craig and Antonelli

[57] ABSTRACT

To start-spin a thread with open-end spinning, the end of the thread is inserted into a spinning rotor against the normal direction of draw, placed on a ring there formed of fed fibres and drawn off again. The end of the thread is placed on the ring at a start-spinning speed which is lower than the operating speed of the spinning rotor. In order to avoid undesired changes in the thickness and strength, etc. of the thread at the start-spinning point, the feed of the sliver, which determines the thickness of the ring of fibres located in the spinning rotor, is reduced in a ratio to the normal operating condition which at least approximates the ratio between the start-spinning speed of the spinning rotor and its operating speed.

28 Claims, 3 Drawing Figures

METHOD AND APPARATUS FOR START-SPINNING A THREAD ON AN OPEN-END SPINNING UNIT

Figure 1:
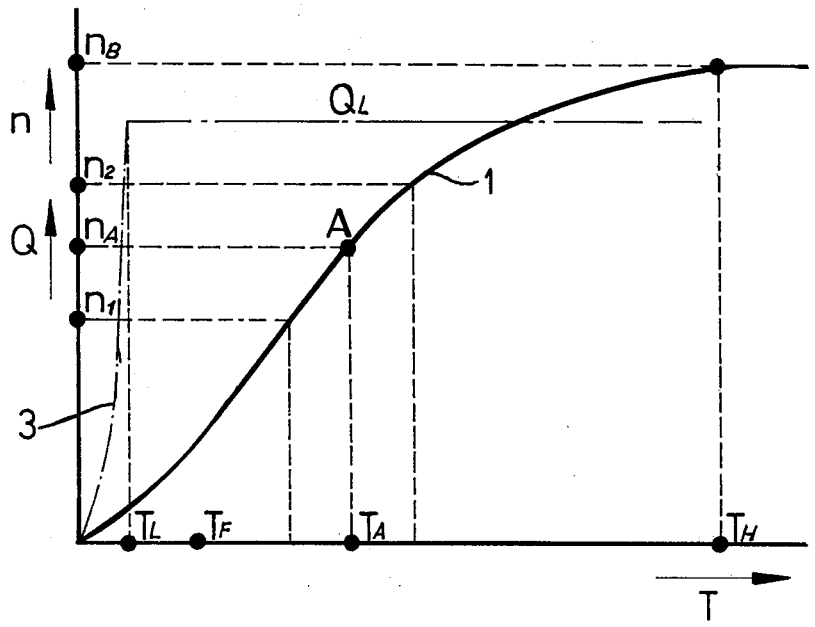

This is a continuation of application Ser. No. 493,158, filed July 30, 1974, now abandoned.

The present invention relates to a method and an apparatus for start-spinning a thread on an open-end spinning unit, in which, for remedying a thread break or for starting, etc., an end of the thread is returned to the spinning rotor, placed on a ring of fibres located therein, and then drawn off again.

With open-end spinning, start-spinning a thread numbers among the most difficult operations, as precisely stipulated conditions must be maintained. In order to simplify the work of the operating personnel, a number of largely automated start-spinning apparatuses are known which have, however, considerable disadvantages. The disadvantages of the known apparatuses are particularly apparent when start-spinning must be performed on spinning machines with very high operating speeds which can be on the order of over 70,000 r.p.m., for example, which can be mastered today with respect to spinning technology.

In order to reduce the difficulties which occur increasingly at increased speeds, it is known practice (German Laid Open Patent Application No. 2,058,604) to reduce the speed of the entire spinning machine for start-spinning a broken thread. However this represents a production loss, which is extremely noticeable if the number of thread breaks is high. Moreover, this reduction in the speed of the entire machine has a negative effect on the yarn produced at those spinning points which continue to operate, as this yarn has a different elongation characteristic or a different appearance, for example.

It is also known practice to reduce the speed of each individual spinning unit independently of the other spinning units (Swiss Pat. No. 531,059), thereby eliminating the above mentioned disadvantages. However considerable constructional effort is required for this known type of design. Moreover, there are varying yarn diameters in the area of the start-spinning points with a start-spinning method of this type, especially thicker areas which necessitate a subsequent rewinding operation in actual practice, during which the start-spinning points are removed from the yarn.

It is the object of th e present invention to create a method for start-spinning a thread in which there is neat start spinning, without increasing the thickness of the yarn, etc. The invention comprises the combination of the characteristics that while the end of the thread is being placed on the ring of fibres the speed of the spinning rotor is reduced relative to the operating speed thereof, and that the feed of the sliver is reduced in accordance with the reduced start-spinning speed by delayed switch-on of its drive, delayed start-up until the operating conditions have been reached, or brief interruptions of the drive. The invention is based upon the fact that points of increased yarn thickness during start-spinning at reduced speed are primarily caused by the fact that the sliver feed for this operation must be altered relative to the normal operating conditions, because there are other spinning conditions during piecing operations.

In an especially advantageous development of the invention, the end of the thread is placed on the ring of fibres during start-up of the previously braked spinning rotor prior to attainment of the operating speed thereof. This permits, without a complicated design of the machine drive, utilization of a speed for the start-spinning operation which is lower than the operating speed of the spinning rotor, whereby this reduced speed can be located in the area between O and the operating speed through suitable switching measures.

In an advantageous apparatus for performing the method according to the invention there is a starting switch, which can be actuated by a component of a brake of the spinning rotor, especially a brake lever, when said brake is released, said starting switch being connected with the means, controlled in accordance with a preselected programme, for returning the end of the thread and drawing it off again and means for influencing the feed of the sliver. Through selection of the programme, it is possible to achieve the desired coordination between start-spinning speed and sliver feed, for which purpose suitable time-delay means or timer mechanisms, etc. can be employed. In an advantageous embodiment, the start-spinning means are located in a unit which can be moved along the spinning machine.

Figure 2:
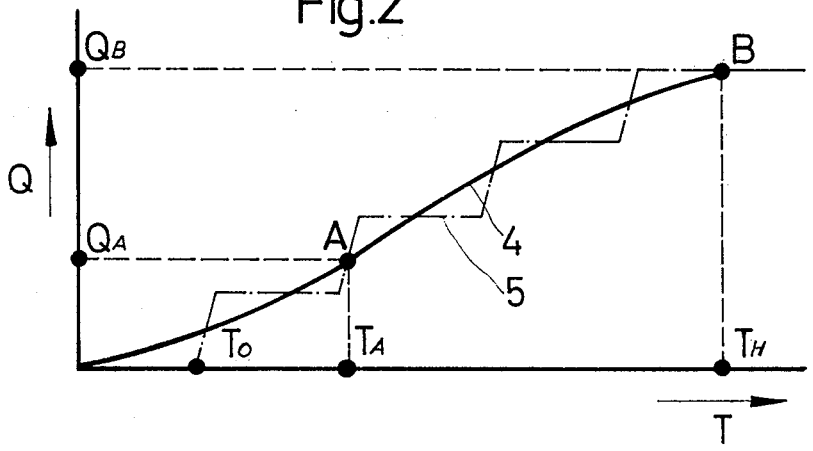
Figure 3:
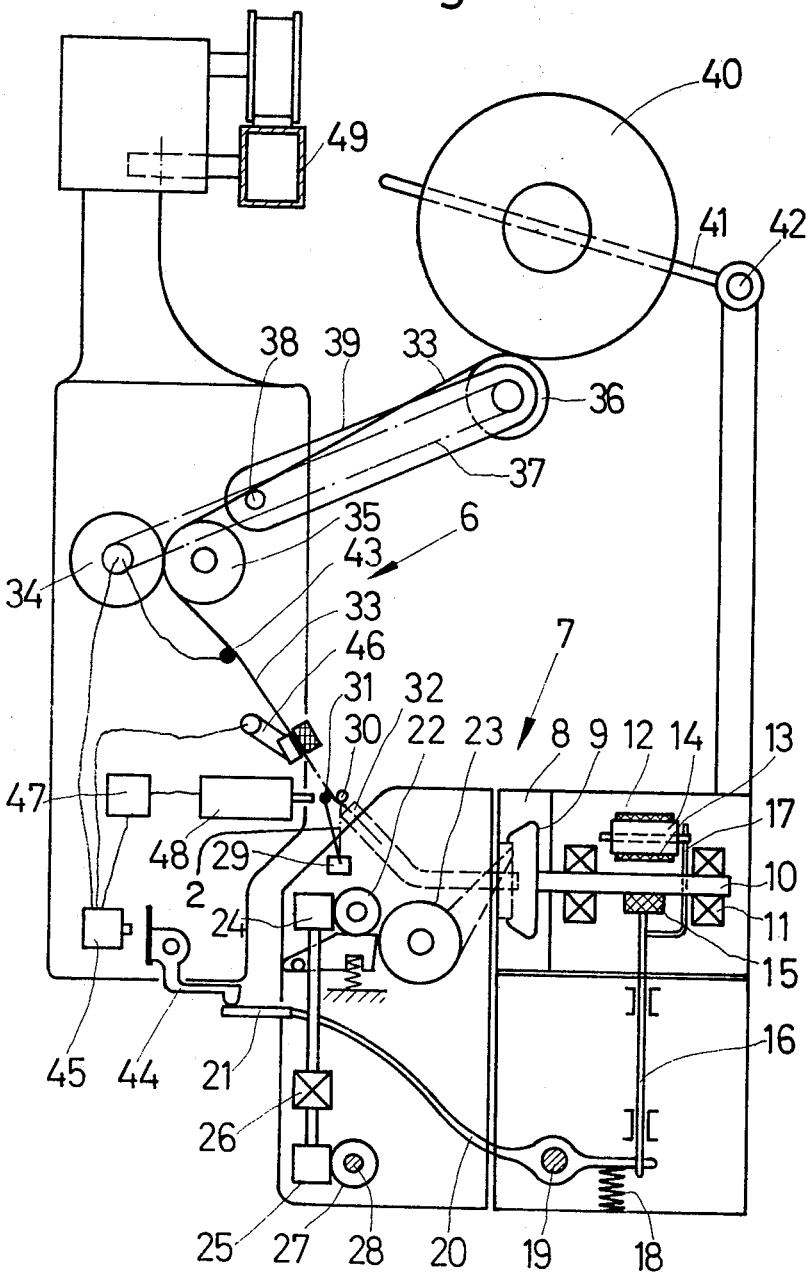

The above discussed and other objects, features and advantages of the present invention will become more apparent from the following description thereof, when taken in connection with the accompanying drawings, in which FIG. 1 shows a graphic representation of the starting sequence of a spinning unit with the start-spinning operation indicated therein;

FIG. 2 shows a graphic representation of a reduced sliver feed during the starting sequence of a spinning unit; and FIG. 3 shows an apparatus according to the invention for performing the method according to the invention.

Referring now to the drawings, wherein like reference numerals designate like parts throughout the several views, FIG. 1 shows the speed n of a spinning rotor during time T, in the form of a curve, during the starting sequence. The spinning rotor, starting from a standstill, reaches the operating speed $n_B$ at the moment $T_H$. It has been shown that a favourable speed range, in which the start-spinning operation can be performed most reliably, is located between speeds $n_1$ and $n_2$, for example. Within this range, it is possible to stipulate the start-spinning point A on curve 1, which then also includes start-spinning time $T_A$ and start-spinning speed $n_A$, which is clearly below operating speed $n_B$.

To perform start spinning at point A, the end of the thread must be returned prior to start-spinning time $T_A$, for example at time $T_F$, indicated on the abscissa, in order for the end of the fibre to reach the ring of fibres deposited in the spinning rotor at time $T_A$, whereupon draw-off of the thread is initiated.

The dash-dotted curve 3 also contained in FIG. 1 represents the course of sliver feed Q through time T. As can be seen from this curve 3, after a short time the sliver feed attains its maximum value $Q_L$ at time $T_L$. The period of time required therefor is considerably shorter than the period of time required for the starting sequence of the spinning rotor.

The curves 1 and 3 in FIG. 3 show clearly that at start-spinning time $T_A$ the fibre feed is greater than that required by operating conditions, which must result in a change in the yarn quality at the start-spinning point. For this reason, measures must be taken to ensure a suitable ratio between the fibre feed at start-spinning time $T_A$ and the reduced start-spinning speed $n_A$ of the spinning rotor. This is possible, for example, in that the fibre feed is initiated with a delay, so that time $T_L$, at which the operating feed quantity $Q_L$ is attained, is after start-spinning time $T_A$. Because of the steepness of curve 3, the switch-on and start-spinning must be performed at precisely stipulated moments, as the sliver feed conditions change very rapidly. In order to provide a longer period of time for the start-spinning operation, it is therefore advantageous to provide aids through which the steepness of curve 3 can be reduced, permitting operating feed $Q_L$ to be attained later.

It would be favourable for the start-spinning operation if curve 3 were influenced in such a manner that it had the same steepness as curve 1. A curve 4 of this type is illustrated in FIG. 2, which shows feed Q over time T. However in actual practice, realization of a curve 4 of this type for the starting sequence of the feed operation presents relatively great difficulties and necessitates considerable manufacturing effort. Tests have shown that it is generally sufficient if this course of curve 4 is approximated. This is possible through a curve 5, indicated as a dash-dotted line in FIG. 2, for example, which has the same steepness as curve 3 but is extended in stages in such a manner that it approximates curve 4. This type of staging of curve 5, which characterizes the starting-sequence behaviour of the fibre feed, can be provided in a simple manner by delayed switch-on at time $T_O$, followed by repeatedly switching off the drive briefly. Tests have shown that a method of this type leads to very good results in actual practice.

FIG. 3 shows an apparatus with which it is possible to attain sliver feed according to curve 5 in FIG. 2. This apparatus comprises a start-spinning unit 6, which travels along a rail 49 on an open-end spinning machine, of which only one spinning point 7 is illustrated. Rotating in an underpressure chamber 8 is a spinning rotor 9, whose shaft 10 is mounted in bearings 11, which can be of any desired design. In this embodiment, rotor shaft 10 is driven by means of a tangential belt 12, 13, whose lower side 13 is pressed against rotor shaft 10 by a pressure roller 14 in the operating condition. In the illustrated condition, pressure roller 14, and thus lower side 13 of tangential belt 12, 13, is lifted away from rotor shaft 10. Rotor shaft 10 can be braked by means of a brake 15. The actuating rod 16 for brake 15 is coupled to a lift-off mechanism 17 for pressure roller 14. Actuating rod 16 of brake 15 can be adjusted against the force of a tension spring 18 by means of a double lever 20, which can be swiveled about the stationary point 19. The outer end 21 of double lever 20 can be operated from the outside.

Located in front of spinning rotor 9 are a feed roller 22 for the sliver and a separating roller 23. Feed roller 22 is driven from the gear 27 of a drive shaft 28 by a vertical shaft with a solenoid clutch 26 via helical gears 24 and 25. Solenoid clutch 26 is electrically connected with the switch 29 of a thread stop-motion 2, which assumes the dash-dotted position 30 during operation and position 31 directly at the outlet of a yarn removal channel 32 in the event of a thread break. In the latter case, the drive of feed roller 22 is switched off by solenoid clutch 26.

The end 33 of the thread to be start-spun is reinserted into spinning rotor 9 through yarn removal channel 32 by start-spinning unit 6. This is performed by draw-off rollers 34 and 35, of which roller 34 can be driven in either sense of rotation; by the winding roller 36, which can also be driven in either sense of rotation by means of a toothed belt 37 connected with roller 34; and by the suction of an underpressure in an underpressure chamber 8 in which spinning rotor 9 rotates. In addition, winding roller 36 can be lifted and lowered by means of an arm 39 which can be swivelled about axle 38, permitting a cone 40, which can be swivelled about a stationary axle 42 on spinning unit 7 by means of a cone arm 41, to be lifted off into the position shown in FIG. 3, as needed, from an unillustrated winding roller of spinning unit 7. In the operating condition, however, winding roller 36 of the start-spinning unit 6 is not in a contacting relationship with cone 40. Reversal of the sense of rotation of rollers 34 and 36 is controlled by means of a thread tension feeler 43.

Start-spinning unit 6 is switched on by means of an actuating lever 44, which acts upon a starting switch 45 equipped with a time-lag relay. Said starting switch 45 is electrically coupled with a drive motor of draw-off roller 34, a rotatable thread trapper 46 and, finally, with a two-way switch 47. By means of a solenoid 48 and thread stop-motion 30, 31, two-way switch 47 can actuate switch 29, which switches the sliver feed on or off with the aid of solenoid clutch 26. As long as the thread 33 to be start-spun does not have sufficient tension, the thread stop-motion will always immediately assume position 31 as soon as solenoid 48 has retracted its plunger.

Start-spinning unit 6 operates in the following manner:

The initial position is illustrated in FIG. 3, i.e. rotor shaft 10 is braked, actuating lever 44 is in a contacting relationship with the outer end 21 of double lever 20, thread trapper 46 holds the thread 33 to be start spun in the illustrated position (leaving the dash-dotted extension of thread 33 out of consideration for the moment), driven rollers 34 and 36 are stopped, and cone 40 is in a contacting relationship with winding roller 36 and has no direct contact with spinning unit 7.

After the brake is released, the outer end 21 of double lever 20 moves upward under the effect of tension spring 18. This lowers actuating rod 16 of brake 15 and lift-off mechanism 17 for pressure roller 14, i.e. tangential belt 13 presses against rotor shaft 10, thereby driving spinning rotor 9. On the other hand, actuating lever 44 of start-spinning unit 6 is lifted, thereby actuating starting switch 45. By means of a time-lag relay or similar component connected with said switch 45, both draw-off roller 34 and winding roller 36 are driven in such a manner, with simultaneous opening of thread trapper 46, that the thread 33 to be start spun is introduced into yarn removal channel 32 and further into spinning rotor 9. The partially introduced thread 33 is indicated by the dash-dotted line. In addition, starting switch 45 also actuates a two-way switch 47, connected therewith, which places the thread stop-motion alternately in positions 30 and 31 at the preselected time and at preselected distances by means of solenoid 48, thus switching thread stop-motion switch 29 on and off, thereby causing feed roller 22 for the sliver to be alternately driven and stopped by means of solenoid clutch 26. This entire sequence must be concluded before spinning rotor 9 has reached its operating speed. At a given, preselected tension of thread 33, which has now been start-spun, thread tension feeler 43 causes rollers 34 and 36 to reverse direction, with gentle starting, whereupon the actual start-spinning operation is concluded. Cone 40 and thread 33 must then be returned to spinning unit 7.

The apparatus illustrated in FIG. 3 provides the advantage that it operates exclusively with components which are independent of the spinning unit and only engage the controls thereof mechanically. It is also possible to provide each spinning unit with a connection for a plug or similar component of the mobile unit in order to perform start spinning. In this case, it is possible to eliminate mechanical components for transmission of the initiation of control operations, which could possibly result in a more precise method of operation.

Obviously, many modifications and variations of the present invention are possible in the light of the above teachings. It should therefore be understood that within the scope of the appended claims, the invention may be practiced otherwise than as specifically described.

Having thus fully disclosed our invention, what we claim is:

1. Apparatus for yarn piecing in an open-end spinning assembly comprising:

fibre feeding means for supplying fibre to a spinning rotor of said spinning assembly to form a fibre ring in said rotor, rotor decelerating means for decelerating the speed of the rotor from an operational speed, piecing means including means for introducing a yarn end back into said spinning rotor to be pieced together with the fibre ring formed in said spinning rotor from said fibre, piecing control means for controlling the timing of the introduction of said yarn back into said spinning rotor to occur during acceleration of said spinning rotor from said decelerated condition toward its operating spinning speed and before said spinning rotor reaches its operating spinning speed, and feed control means for controlling the fibre feeding means separately from the control of the spinning rotor speed to vary the supply of fibre to said spinning rotor as said spinning rotor is accelerated during the piecing operation to correlate the fibre feeding speed to the speed of the spinning rotor during piecing as said spinning rotor is accelerated.

2. Apparatus according to claim 1, wherein brake means are provided for braking the rotational movement of said spinning rotor, and wherein said piecing control means includes means for initiating introduction of said yarn back into said spinning rotor a predetermined period of time after release of said brake means.

3. Apparatus according to claim 2, wherein said fibre feeding means includes feeder drive means for drivingly feeding fibre to said spinning rotor as a function of the speed of said feeder drive means, and wherein said feed control means includes means for controlling the speed of said feeder drive means independently of the speed of said spinning rotor.

4. Apparatus according to claim 3, wherein rotor drive means are provided for continuously accelerating said spinning rotor from its braked condition to its operating spinning speed, and wherein said feed control means includes means for intermittently energizing and de-energizing said feeder drive means so that the velocity of said feeder drive means increases in a step-wise manner during said piecing operation, whereby the velocity of said feeder drive means is made to correspond generally to the velocity of said spinning rotor during the piecing operation.

5. Apparatus according to claim 4, wherein said rotor drive means includes a continously moving common drive means which extends adjacent a plurality of spinning rotors and is selectively movable into driving engagement with said spinning rotors, and wherein respective ones of said spinning rotors are automatically accelerated to the operating spinning speed thereof upon release of the associated brake means at said spinning rotor.

6. Apparatus according to claim 1, wherein said fibre feeding means includes feeder drive means for drivingly feeding fibre to said spinning rotor as a function of the speed of said feeder drive means, and wherein said feed control means includes means for controlling the speed of said feeder drive means independently of the speed of said spinning rotor.

7. Apparatus according to claim 6, wherein said feed control means includes means for intermittently energizing and de-energizing said feeder drive means so that the velocity of said feeder drive means increases in a step-wise manner during said piecing operation.

8. Apparatus according to claim 1, wherein rotor drive means are provided for continuously accelerating said spinning rotor from a braked condition to its operating spinning speed, wherein said fibre feeding means includes feeder drive means for drivingly feeding fibre to said spinning rotor as a function of the speed of said feeder drive means, and wherein said feed control means includes means for controlling the speed of said feeder drive means independently of the speed of said spinning rotor.

9. Apparatus according to claim 8, wherein said feed control means includes means for intermittently energizing and de-energizing said feeder drive means so that the velocity of said feeder drive means increases in a step-wise manner during said piecing operation.

10. Apparatus according to claim 9, wherein said rotor drive means includes a continuously movable belt which drivingly rotates said spinning rotor upon release of a spinning rotor brake, and wherein said feed control means is activated in response to release of said spinning rotor brake.

11. Method for yarn piecing in an open-end spinning assembly comprising:

supplying sliver to a spinning rotor of said spinning assembly by means of fibre feeding means to form a fibre ring in said rotor, decelerating the speed of the spinning rotor to a decelerated condition with a lower speed than the spinning rotor operating speed, introducing a yarn end back into said spinning rotor to be pieced together with the fibre ring formed in said spinning rotor from said fibre, utilizing piecing means, controlling the timing of the introduction of said yarn back into said spinning rotor to occur during acceleration of said spinning rotor from its decelerated condition toward its operating spinning speed and before said spinning rotor reaches its operating spinning speed, by means of piecing control means, and controlling the fibre feeding means with feed control means separately from the control of the spinning rotor speed to vary the supply of fibre to said spinning rotor as said spinning rotor is accelerated during the piecing operation to correlate the fibre feeding speed to the speed of the spinning rotor during piecing as said spinning rotor is accelerated.

12. A method according to claim 11, wherein said deceleration step includes utilizing brake means for braking the rotational movement of said spinning rotor, and wherein said piecing control means includes means for initiating introduction of said yarn back into said spinning rotor a predetermined period of time after release of said brake means.

13. A method according to claim 12, wherein said fibre feeding means includes feeder drive means for drivingly feeding fibre to said spinning rotor as a function of the speed of said feeder drive means, and wherein said feed control means includes means for controlling the speed of said feeder drive means independently of the speed of said spinning rotor.

14. A method according to claim 13, wherein rotor drive means are provided for continuously accelerating said spinning rotor from its braked condition to its operating spinning speed, and wherein said feed control means includes means for intermittently energizing and denergizing said feeder drive means so that the velocity of said feeder drive means increases in a stepwise manner during said piecing operation, whereby the velocity of said feeder drive means is made to correspond generally to the velocity of said spinning rotor during the piecing operation.

15. A method according to claim 14, wherein said rotor drive means includes a continuously moving common drive means which extends adjacent a plurality of spinning rotors and is selectively movable into driving engagement with said spinning rotors, and wherein respective ones of said spinning rotors are automatically accelerated to the operating spinning speed thereof upon release of the associated brake means at said spinning rotor.

16. A method according to claim 11, wherein said fibre feeding means includes feeder drive means for drivingly feeding fibre to said spinning rotor as a function of the speed of said feeder drive means, and wherein said feed control means includes means for controlling the speed of said feeder drive means independently of the speed of said spinning rotor.

17. A method according to claim 11, wherein said feed control means includes means for intermittently energizing and deenergizing said feeder drive means so that the velocity of said feeder drive means increases in a step-wise manner during said piecing operation.

18. A method according to claim 11, wherein rotor drive means are provided for continuously accelerating said spinning rotor from a braked condition to its operating spinning speed, wherein said fibre feeding means includes feeder drive means for drivingly feeding fibre to said spinning rotor as a function of the speed of said feeder drive means, and wherein said feed control means includes means for controlling the speed of said feeder drive means independently of the speed of said spinning rotor.

19. A method according to claim 18, wherein said feed control means includes means for intermittently energizing and deenergizing said feeder drive means so that the velocity of said feeder drive means increases in a step-wise manner during said piecing operation.

20. A method according to claim 19, wherein said rotor drive means includes a continuously movable belt which drivingly rotates said spinning rotor upon release of a spinning rotor brake, and wherein said feed control means is activated in response to release of said spinning rotor brake.

21. A method for start-spinning a thread on open-end spinning units of an open-end spinning machine, in which a ring of fibres is deposited in a spinning rotor and in which an end of the thread is returned to the spinning rotor, placed on the ring of fibres deposited in said spinning rotor and then drawn off again, whereby during said placing of said end of the thread on said ring of fibres, the speed of said spinning rotor is reduced relative to its operating speed and whereby a mobile start-spinning unit intervenes in the drive and/or control of means providing the sliver feed and thus controlling the volume of said ring of fibres deposited in said spinning rotor, wherein said thread is returned to said spinning rotor and placed on said ring of fibres during acceleration of said spinning rotor from a previously braked condition to its operating speed.

22. An apparatus for start-spinning a thread on an open-end spinning unit of an open-end spinning machine, having a mobile start-spinning unit with means for depositing a ring of fibres in a spinning rotor of the spinning unit and means for returning an end of the thread to the spinning rotor, means for placing said end of the thread on the ring of fibres located in said spinning rotor and for drawing off the start-spun thread again, as well as means for reducing the speed of said spinning rotor relative to its operating speed, and means which intervene in one of drive means and control means providing the feed of the sliver forming said fibre ring for the purpose of reducing the rate of said formation of said fibre ring, wherein a common mechanical drive means is provided for rotatably driving spinning rotors of a plurality of said spinning units, and wherein said means which intervene include means for interrupting the rotatable drive of one of said spinning rotors without interrupting the rotatable drive of the other of said commonly driven spinning rotors.

23. An apparatus for start-spinning a thread on an open-end spinning unit of an open-end spinning machine, having a mobile start-spinning unit with means depositing a ring of fibres in a spinning rotor of the spinning unit and means for returning an end of the thread to the spinning rotor means for placing said end of the thread on a ring of fibres located in said spinning rotor and for drawing off the start-spun thread again, as well as means for reducing the speed of said spinning rotor relative to its operating speed, and means which intervene in one of drive means and control means providing the feed of the sliver forming said fibre ring for the purpose of reducing the rate of said formation of said fibre ring, wherein said means for placing said end of the thread and said means for reducing the speed of said spinning rotor relative to its operating speed are constructed and synchronized such that said thread is returned to said spinning rotor and placed on said ring of fibres during acceleration of said spinning rotor from a previously braked condition to its operating speed.

24. An apparatus for start-spinning a thread on an open-end spinning unit of an open-end spinning machine, having a mobile start-spinning unit with means for depositing a ring of fibres in a spinning rotor of the spinning unit and means for returning an end of the thread to the spinning rotor means for placing said end of the thread on a ring of fibres located in said spinning rotor and for drawing off the start-spun thread again, as well as means for reducing the speed of said spinning rotor relative to its operating speed, and means which intervene in control means providing the feed of the sliver forming said fibre ring for the purpose of reducing the rate of said formation of said fibre ring, in which the start-spinning unit contains intermittently operating switching means which can be connected with the switching means of a clutch which is associated to the sliver feed and which can be switched on and off.

25. A method for start-spinning a thread on an open-end spinning unit of an open-end spinning machine, comprising:

depositing a ring of fibres in a spinning rotor of the spinning unit, reducing the speed of the spinning rotor of said spinning unit to a speed below its operational spinning speed, intervening in at least one of the drive and control of sliver feed means of said spinning unit so as to control the volume of fibres deposited by said sliver feed in said spinning rotor, placing an end of a thread piece on the ring of fibres deposited in said spinning rotor and drawing said thread piece out of said spinning rotor up on connection of said end with said fibres.

and controlling the speed of said rotor and the timing of said intervening step such that the rotor is accelerating toward said operational spinning speed during said placing step.

26. An apparatus for start-spinning a thread on an open-end spinning unit of a open-end spinning machine, said apparatus comprising:

sliver feed means for depositing a ring of fibres on a spinning rotor of the spinning unit, reducing means for reducing the speed of the spinning rotor of said spinning unit to a speed below its operational spinning speed, intervening means for intervening in at least one of the drive and control of the sliver feed means of said spinning unit so as to control the volume of fibres deposited by said sliver feed in said spinning rotor, placing means for placing an end of a thread piece on the ring of fibres deposited in said spinning rotor and drawing said thread piece out of said spinning rotor upon connection of said end with said fibres, and controlling means for controlling the speed of said rotor and the timing of said intervening step such that the rotor is accelerating toward said operational spinning speed during said placing by said placing means.

27. Apparatus according to claim 26, wherein said spinning unit is one of a plurality of spinning units having respective spinning rotors driven by a common main drive means, and wherein said control means includes means for interrupting the drive connection between said main drive means and one of said spinning rotors without interrupting the drive connection of other of said spinning rotors and said main drive means.

28. Apparatus according to claim 26, wherein said reducing means, intervening means, placing means, and controlling means are carried on a mobile unit which is mounted for movement along a plurality of spinning units.

* * * * *